US008417172B2

(12) United States Patent
Sato et al.

(10) Patent No.: US 8,417,172 B2
(45) Date of Patent: Apr. 9, 2013

(54) POWDER COLLECTING CONTAINER AND IMAGE FORMING APPARATUS

(75) Inventors: Tomonori Sato, Kanagawa (JP); Fumiaki Maekawa, Kanagawa (JP); Hiroki Ando, Kanagawa (JP); Satoshi Honobe, Kanagawa (JP); Toshiyuki Matsui, Kanagawa (JP); Tsuneo Fukuzawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 364 days.

(21) Appl. No.: 12/782,460

(22) Filed: May 18, 2010

(65) Prior Publication Data

US 2011/0085835 A1 Apr. 14, 2011

(30) Foreign Application Priority Data

Oct. 9, 2009 (JP) ..... 2009-235045
Nov. 19, 2009 (JP) ..... 2009-264429

(51) Int. Cl.
*G03G 21/12* (2006.01)

(52) U.S. Cl.
USPC ..... 399/360; 399/35

(58) Field of Classification Search ..... 399/35, 399/358, 359, 360
See application file for complete search history.

(56) References Cited

U.S. PATENT DOCUMENTS

| | | | | |
|---|---|---|---|---|
| 4,627,716 | A * | 12/1986 | Oka | 399/360 |
| 4,982,230 | A * | 1/1991 | Ogura et al. | 399/35 |
| 4,982,231 | A * | 1/1991 | Matsuuchi | 399/35 |
| 6,298,217 | B1 * | 10/2001 | Murayama et al. | 399/358 |
| 6,505,022 | B2 * | 1/2003 | Kosuge et al. | 399/359 X |
| 6,937,838 | B2 * | 8/2005 | Ishii et al. | 399/358 |
| 8,184,999 | B2 * | 5/2012 | Kyung | 399/35 |
| 2007/0201887 | A1 * | 8/2007 | Shakui | 399/35 X |
| 2008/0317483 | A1 * | 12/2008 | Tanimoto et al. | 399/35 |
| 2009/0074434 | A1 * | 3/2009 | Ishii | 399/35 |

FOREIGN PATENT DOCUMENTS

| | | | |
|---|---|---|---|
| JP | 09-218627 | A | 8/1997 |
| JP | 2001-324904 | A | 11/2001 |
| JP | 2008-83626 | A | 4/2008 |
| JP | 2008-309987 | A | 12/2008 |

* cited by examiner

*Primary Examiner* — Sandra Brase
(74) *Attorney, Agent, or Firm* — Sughrue Mion, PLLC

(57) ABSTRACT

A powder collecting container includes: a first chamber that is configured to store collected powder; a conveying unit that has a rotary shaft, and a powder conveying blade formed to be wound around the rotary shaft, the conveying unit being arranged along an upper-limit zone for accommodating powder in the first chamber and configured to convey powder which is contained in the first chamber and located at a position exceeding the upper-limit zone. A hollow member has an opening portion formed in a peripheral wall so that a powder conveying end of the conveying unit is located in the opening portion, and that the conveying unit passes through the hollow member. A second chamber has an inlet provided to face the opening portion so that powder conveyed by the conveying unit enters the second chamber from the inlet.

21 Claims, 14 Drawing Sheets

POWDER COLLECTING CONTAINER AND IMAGE FORMING APPARATUS

CROSS-REFERENCE TO RELATED APPLICATION

This application is based on and claims priority under 35 USC 119 from Japanese Patent Application No. 2009-235045 filed on Oct. 9, 2009 and Japanese Patent Application No. 2009-264429 filed on Nov. 19, 2009.

BACKGROUND

1. Technical Field

The present invention relates to a powder collecting container and an image forming apparatus.

2. Related Art

In image forming apparatuses such as an electrophotographic copying-machine and a laser beam printer, residual toner adhering to a photoreceptor drum is removed by a cleaner after a toner image developed on the photoreceptor drum is transferred onto a recording sheet. The removed residual toner is collected into a waste toner collecting box (powder collecting container) provided in the image forming apparatus as waste toner (used powder).

Recently, a color image forming apparatus has emerged, which obtains a color image by primary-transferring multicolor toner images formed by plural image forming engines from a photoreceptor drum to an intermediate transfer belt and then secondary-transferring the toner images onto a recording sheet. In the case of the color image forming apparatus, the photoreceptor drum and the cleaner for cleaning the photoreceptor drum are present in each of image forming engines respectively corresponding to yellow, cyan, magenta, and black. Accordingly, the necessity of collecting waste toner from the cleaners of the four image forming engines arises. In addition, after the toner images are secondary-transferred from the above intermediate transfer belt to the recording sheet, it is necessary to clean residual toner adhering to the intermediate transfer belt. A cleaner is provided corresponding to the intermediate transfer belt. Thus, in the case of the color image forming apparatus, waste toner is collected into a waste toner collecting box from plural cleaners.

In addition, in order to omit an operation of replacing deteriorated powder in a developing unit using two-component powder containing toner and carrier, the image forming apparatus employs a trickle developing method of discarding the deteriorated powder while the developing unit is replenished with new two-component powder. In the case of employing this developing method, the deteriorated powder discharged from each of the developing units is also collected into the waste toner collecting box.

Waste toner collecting boxes are consumables. Generally, a waste toner collecting box is replaced with an empty waste toner collecting box when the waste toner collecting box is filled with waste toner.

SUMMARY

According to an aspect of the invention, a powder collecting container includes:

a first chamber that is configured to store collected powder;

a conveying unit that has a rotary shaft, and a powder conveying blade formed to be wound around the rotary shaft, the conveying unit being arranged along an upper-limit zone for accommodating powder in the first chamber and configured to convey powder which is contained in the first chamber and located at a position exceeding the upper-limit zone;

a hollow member that has an opening portion formed in a peripheral wall so that a powder conveying end of the conveying unit is located in the opening portion, and that the conveying unit passes through the hollow member; and a second chamber that has an inlet provided to face the opening portion so that powder conveyed by the conveying unit enters the second chamber from the inlet.

BRIEF DESCRIPTION OF THE DRAWINGS

Exemplary embodiments of the invention will be described in detail based on the following figures, wherein.

DETAILED DESCRIPTION

Figure 1:
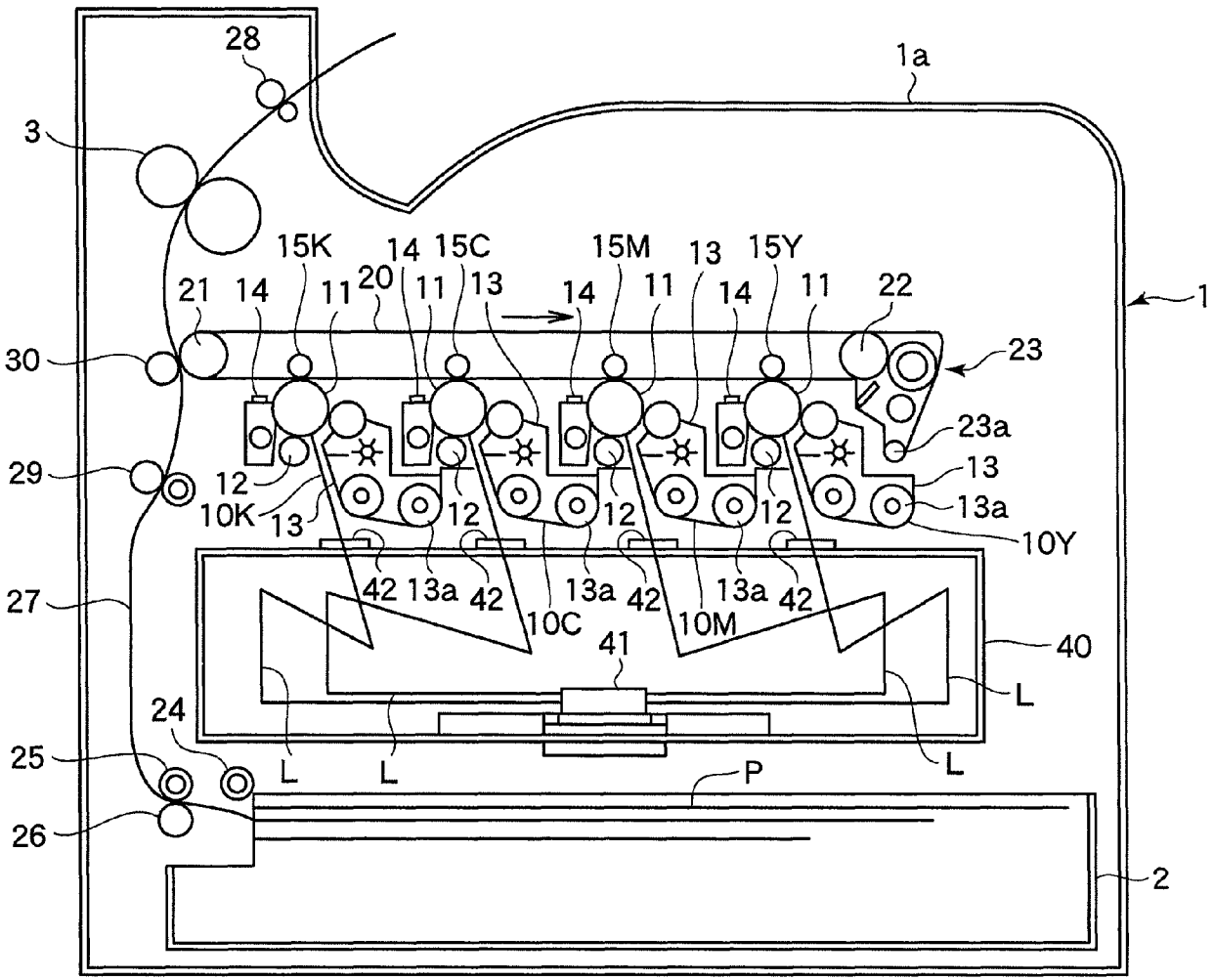
FIG. 1 is a schematic view illustrating a configuration of a printer to which a waste toner collecting box according to one exemplary embodiment of the invention is attached.

Hereinafter, an exemplary embodiment which is an example of the invention is described in detail with reference to the accompanying drawings. Incidentally, in the drawings for illustrating the exemplary embodiment, the same component is, in principle, designated with the same reference numeral. Thus, the repetitive description thereof is omitted.

As illustrated in FIG. 1, a color laser beam printer (image forming apparatus) 1 of the tandem type, to which a waste toner collection box is attached, includes four image forming engines 10Y, 10M, 10C, and 10K, each of which forms a toner image having an associated one of the following colors, i.e., yellow, magenta, cyan and black. The color laser beam printer also includes an intermediate transfer belt 20 to which toner images are transferred (particularly, primary-transferred) from the image forming engines, and is configured so that the toner images multiply-transferred onto the intermediate transfer belt 20 are further transferred (particularly, secondary-transferred) onto a recording sheet P to thereby form a full-color image.

The intermediate transfer belt 20 is formed in an endless shape and laid around a pair of belt conveying rollers 21 and 22. The intermediate transfer belt 20 is configured to undergo the primary transfer of the toner images formed by the image forming engines 10Y, 10M, 10C, and 10K respectively having the above colors while rotating in a direction indicated by an arrow.

A secondary transfer roller 30 is provided at a position facing one of the belt conveying rollers 21 across the intermediate transfer belt 20. The recording sheet P is passed through between the secondary transfer roller 30 and the intermediate transfer belt 20, which are contacted with each other while pushing each other. Thus, the recording sheet P is subjected to the secondary transfer of the toner images from the intermediate transfer belt 20 thereonto. On the other hand, a belt cleaner 23 for the intermediate transfer belt 20 is disposed at a position facing a belt conveying roller 22 placed at the opposite side and removes residual toner adhering onto the intermediate transfer belt 20 therefrom. The residual toner removed by the belt cleaner 23 is conveyed as waste toner to a front side (i.e., the near side of a page on which FIG. 1 is drawn) by a conveying shaft 23*a* having a helical blade, and collected into a waste toner collection box that will be described below.

The aforementioned four image forming engines 10Y, 10M, 10C, and 10K are parallel-arranged under the intermediate transfer belt 20, so that a toner image formed according to image information corresponding to each color is primary-transferred onto the intermediate transfer belt 20. The four image forming engines 10Y, 10M, 10C, and 10K are arranged along the direction of rotation of the intermediate transfer belt 20 in the order of the colors respectively associated therewith, i.e., yellow, magenta, cyan, and black. Thus, the black image forming engine 10K that is generally most frequently used is disposed in the vicinity of a secondary transfer position.

A raster scanning unit 40 for exposing a photoreceptor drum 11 attached to each of the image forming engines 10Y, 10M, 10C, and 10K according to image information is provided under the image forming engines 10Y, 10M, 10C, and 10K. The raster scanning unit 40 is shared by all the image forming engines 10Y, 10M, 10C, and 10K, and includes four semiconductor lasers (not shown) that respectively emit laser-light beams L modulated according to image information corresponding to each color, and a single polygon mirror 41 configured to rotate at high speed to scan the four laser light beams L along the axial direction of the photoreceptor drum 11. Then, each laser beam L scanned by the polygon mirror 41 proceeds through a predetermined path while reflected by mirrors (not shown). After that, each laser beam L exposes the photoreceptor drum 11 attached to the associated one of the image forming engines 10Y, 10M, 10C, and 10K through a scan window 42 provided in an upper portion of the raster scanning unit 40.

Each of the image forming engines 10Y, 10M, 10C, and 10K includes the photoreceptor drum 11, a charging roller 12 for charging a surface of the photoreceptor drum to a predetermined electric potential level, a developing unit 13 for developing an electrostatic latent image that is formed on the photoreceptor drum 11 by exposure with laser light beams L, and a drum cleaner 14 for removing residual toner and paper powder from the surface of the photoreceptor drum 11 after the toner image is transferred onto the intermediate transfer belt 20. Each of the image forming engines 10Y, 10M, 10C, and 10K is configured so that a toner image according to image information corresponding to the associated color is formed on the associated photoreceptor drum 11.

In the printer 1 according to the present exemplary embodiment the developing unit 13 is of the type that uses two-component developer obtained by mixing toner and carrier, and that employs a trickle developing method of replenishing from a replenishing cartridge (not shown) powder obtained by mixing toner and carrier and of automatically discharging a deteriorated powder in order to omit a maintenance operation of replacing powder due to temporal deterioration.

Each of the developing units 13 is replenished with new powder from the rear side (i.e., the far side of the page on which FIG. 1 is drawn) of a conveying shaft 13*a* having helical blades, which is similar to the aforementioned conveying shaft 23*a*. The residual toner removed by each of the drum cleaners 14 is discharged to the front side by a conveying shaft (not shown) as waste toner. Then, the waste toner discharged from the drum cleaner 14 is collected into a waste toner collection box that will be described below.

In the present exemplary embodiment, waste powder including used-toner discharged from the drum cleaner 14 and that discharged from the belt cleaner 23 is collected as an example of the powder to be collected. The invention can be applied to a collecting box for collecting carrier and toner discharged from the developing unit 13, and to a collecting box for collecting only used-toner discharged from the drum cleaner 14.

Each of primary transfer rollers 15Y, 15M, 15C, and 15K is provided at a place facing the photoreceptor drum of an associated one of the image forming engines 10Y, 10M, 10C, and 10K across the intermediate transfer belt 20. An electric field is formed between the photoreceptor drum 11 and each of the transfer rollers 15Y, 15M, 15C, and 15K by applying a transfer bias voltage to the transfer rollers 15Y, 15M, 15C, and 15K. The toner images electrically charged on the photoreceptor drum 11 are transferred onto the intermediate transfer belt 20 by a coulomb force.

On the other hand, the recording sheet P is conveyed from a paper supplying cassette 2 accommodated in a lower portion of the printer 1 to the inside of a casing, more specifically, a secondary transfer position at which the intermediate transfer belt 20 and the secondary roller 30 are contacted with each other. The paper supplying cassette 2 is configured to be set therein by being pushed thereinto from the front side of the printer 1. A pickup roller 24 for drawing out a recording sheet P accommodated in the paper supplying cassette 2 therefrom, and a paper supplying roller 25 are provided at an upper portion of the set paper supplying cassette 2. In addition, a retarding roller 26 for preventing the multiple feeding of a recording sheet P is provided at a position facing the paper supplying roller 25.

A conveying path 27 for conveying a recording sheet P in the printer 1 is provided to extend along the left side surface of the printer 1 in an up/down direction. The recording sheet P drawn out of the paper supplying cassette 2 placed in the bottom portion of the printer 1 rises on the conveying path 27. The entry timing of the recording sheet P is controlled by a registration roller 29. Thus, the recording sheet P is led to the secondary transfer position. After the toner images are transferred onto the recording sheet P at the secondary transfer position, the recording sheet P is sent to a fixing device 3 provided at an upper part of the printer 1. Then, the recording sheet P to which the toner images are fixed by the fixing device 3 is discharged by a discharging roller 28 to a output tray 1*a* provided on the top surface of the printer 1 in a face-down state in which an image forming surface of the recording sheet P is turned towards the output tray 1*a*.

When a full color image is formed by the color laser beam printer 1 of such a configuration, first, the raster scan unit 40 exposes the photoreceptor drum 11 of each of the image forming engines 10Y, 10M, 10C, and 10K at a predetermined timing. Consequently, an electrostatic latent image is formed on the photoreceptor drum 11 of each of the image forming engines 10Y, 10M, 10C, and 10K according to image information. Thus, toner images are formed by supplying toner to these electrostatic latent images.

The toner images respectively formed on the photoreceptor drums 11 of the image forming engines 10Y, 10M, 10C, and 10K are sequentially transferred onto the rotating intermediate transfer belt 20. Consequently, a multiple toner image obtained by superposing the toner images respectively having the colors is formed on the intermediate transfer belt 20. On the other hand, the recording sheet P is sent out from the paper feeding cassette 2. Then, the recording sheet P is passed through between the secondary transfer roller 30 and the intermediate transfer belt 20 at the proper timing at which the toner images primary-transferred onto the intermediate transfer belt 20 reach the secondary transfer position. Consequently, the multiple toner image formed on the intermediate transfer belt 20 is secondary-transferred onto the recording sheet P. Then, the recording sheet P, onto which the multiple toner image is secondary-transferred, is subjected to the fixing of the toner image by the fixing device 3. Accordingly, a full-color image is completed on the recording sheet P.

In the printer 1 according to the present exemplary embodiment having such a configuration, all waste toner discharged from the belt cleaner 23 and each of the drum cleaners 14 is collected into the same waste toner collecting box 50 (an example of the powder collecting container).

Figure 2:
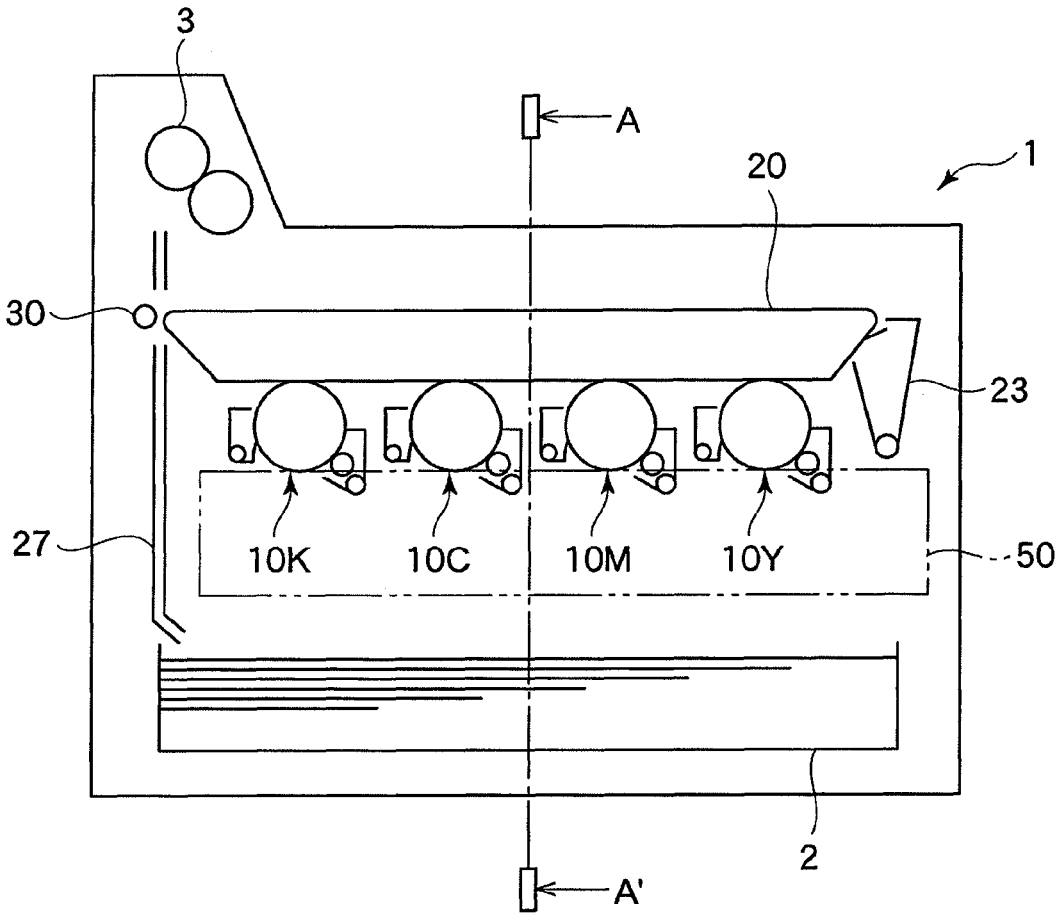
FIG. 2 is a schematic view illustrating a position at which a waste toner collecting box is provided in the printer illustrated in FIG. 1.
Figure 3:
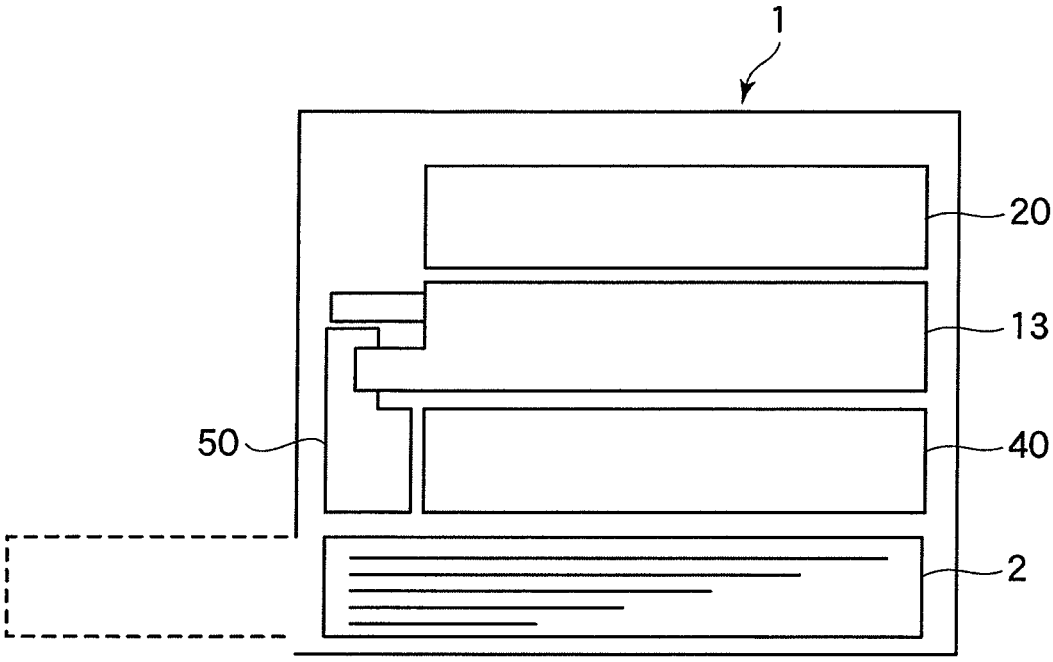
FIG. 3 is a cross-sectional view taken along line A-A' illustrated in FIG. 2.

As illustrated in FIGS. 2 and 3, the waste toner collecting box 50 is provided slightly under the front side of each of the image forming engines 10Y, 10M, 10C, and 10K respectively corresponding to yellow, magenta, cyan, and black, which are parallel-arranged. Waste toner discharged from each drum cleaner 14 to the front side thereof is collected into the waste toner collecting box 50. Waste toner removed from the intermediate transfer belt 20 by the belt cleaner 23 is also collected into the waste toner collecting box 50.

As illustrated in FIGS. 4 to 7, the waste toner collecting box 50 is configured as a casing by integrally joining a plastic front cover 51 and a plastic rear cover 52. A space (including a storing chamber 61, a detecting chamber 67 and so on, which will be described below) is formed in the waste toner collecting box 50. The waste toner collecting box 50 is elongated widthwise and has a shape whose thickness is small as compared with a length in an up/down direction thereof, as viewed in the drawings. The widthwise length of the waste toner collecting box 50 is longer than the distance to the belt cleaner 23 from the drum cleaner 14 of the aforementioned image forming engine 10K corresponding to black. When installed in the printer 1, the waste toner collecting box 50 is placed at the front side of each of the image forming engines 10Y, 10M, 10C, and 10K and the belt cleaner 23 so that waste toner is dropped directly into the internal space (i.e., the storing chamber 61).

Figure 4:
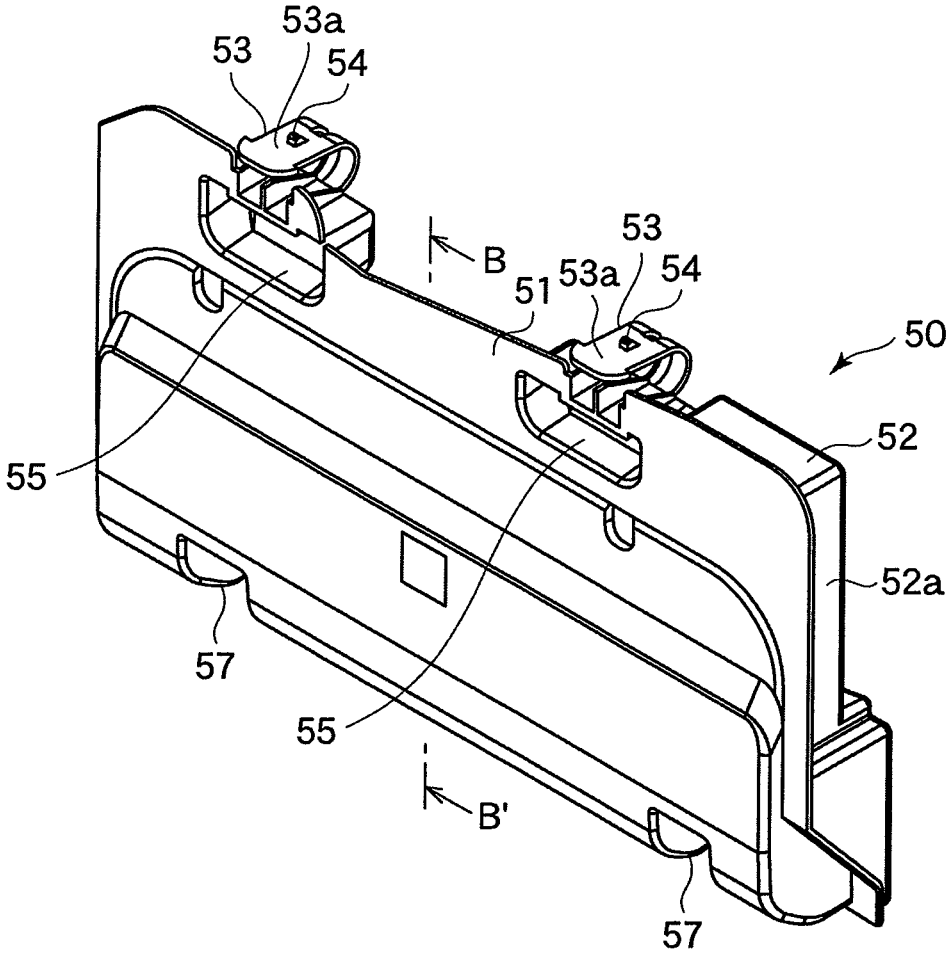
FIG. 4 is a perspective view illustrating a waste toner collecting box according to one exemplary embodiment of the invention, which is taken from a front-surface side thereof.
Figure 5:
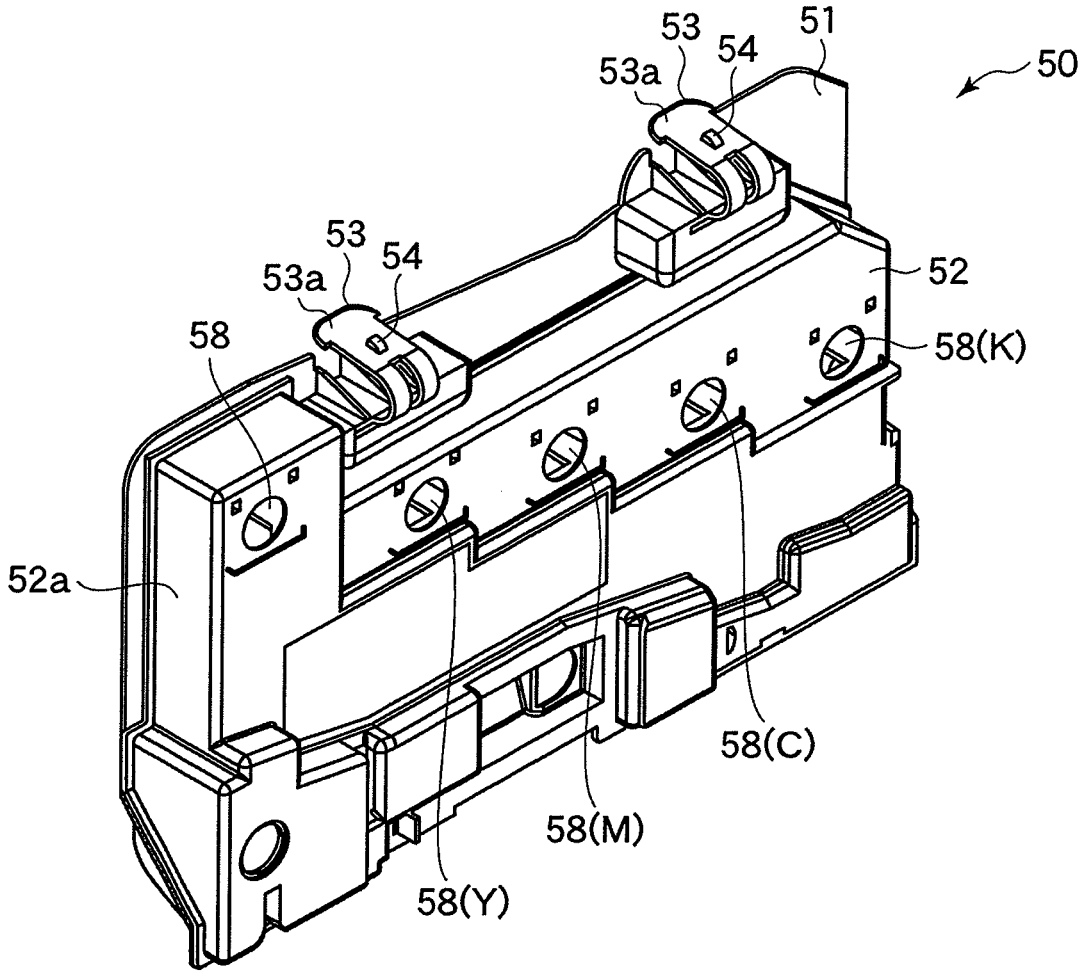
FIG. 5 is a perspective view illustrating the waste toner collecting box according to the one exemplary embodiment of the invention, which is taken from a back-surface side thereof.
Figure 6:
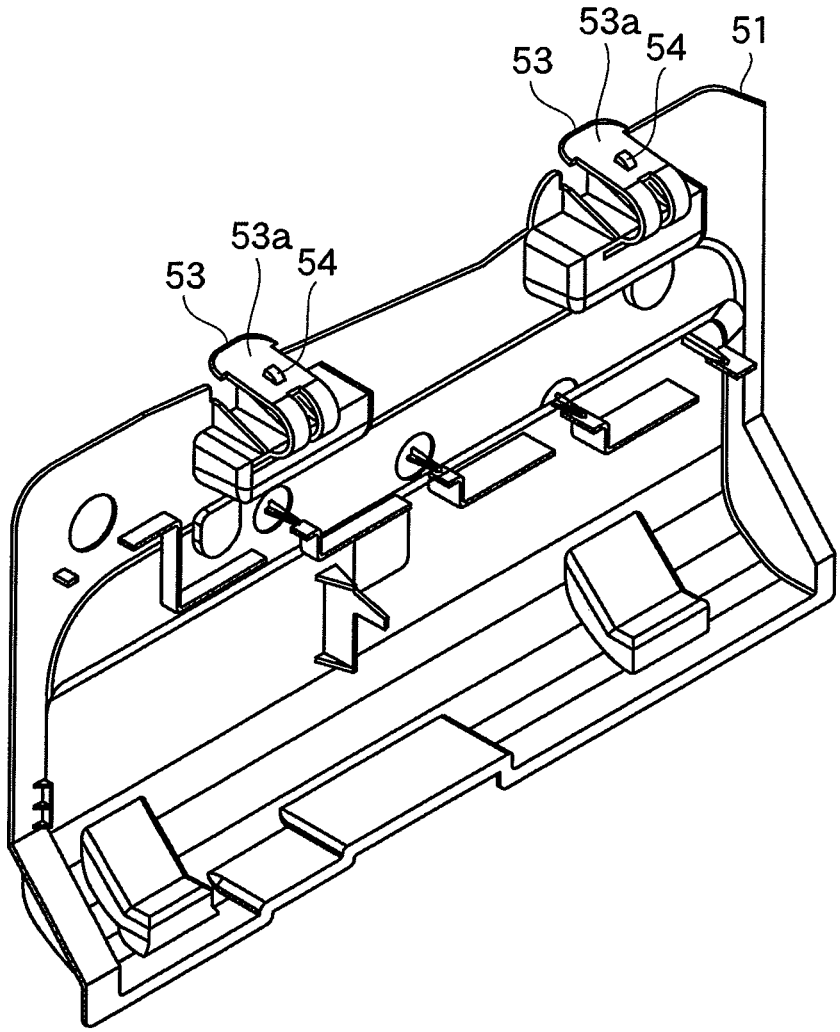
FIG. 6 is a perspective view illustrating the inside of a front cover that is a composing element of the waste toner collecting box according to the one exemplary embodiment of the invention.

As illustrated in FIGS. 4, 5, and 6, lock pieces 53 are formed at two places on an upper portion of the front cover 51 so that a free end of each lock piece 53 is frontwardly directed, that a protrusion portion 54 is formed on the top surface 53*a* of each lock piece 53, and that each lock piece 53 is elastically deformed to cause the top surface 53*a* to move in the up/down direction. In addition, a hole portion 55 frontwardly opened, which has an area sufficient to the extent that a plurality of fingers of an operator can enter there, is formed just under each lock piece 53. A plate-like piece mounting portion 57, in which a plate-like piece 56 protruding downwardly (see FIG. 8) is mounted, is formed at each of two places of a lower portion of the front cover 51.

Thus, when the waste toner collecting box 50 is mounted in the printer 1, the plate-like piece 56 is inserted into a groove portion (not shown) formed at the side of the printer 1. Then, the waste toner collecting box 50 is raised using a part of the plate-like piece 56 as a support point. The protrusion portion 54 is fit into a fixation hole (not shown) formed at the side of the printer 1 while each lock piece 53 is elastically deformed. When the waste toner collecting box 50 is removed from the printer 1, an operator's thumb engages with the free end of the lock piece 53. The other fingers of the operator are inserted into the hole portion 55. Then, the waste toner collecting box 50 is frontwardly tilted down while the lock piece 53 is pushed down by the thumb. Consequently, the fitted state between the protrusion portion 54 and the fixation hole is canceled. The waste toner collecting box 50 is drawn obliquely and upwardly without change.

The waste toner collecting box 50 is removed from the printer 1 in, e.g., the following cases where the waste toner collecting box 50 is full and replaced, where necessity for replacing the intermediate transfer belt unit is caused, and where necessity for replacing one or more of the image forming engines 10Y, 10M, 10C, and 10K placed behind the waste toner collecting box 50.

Figure 7:
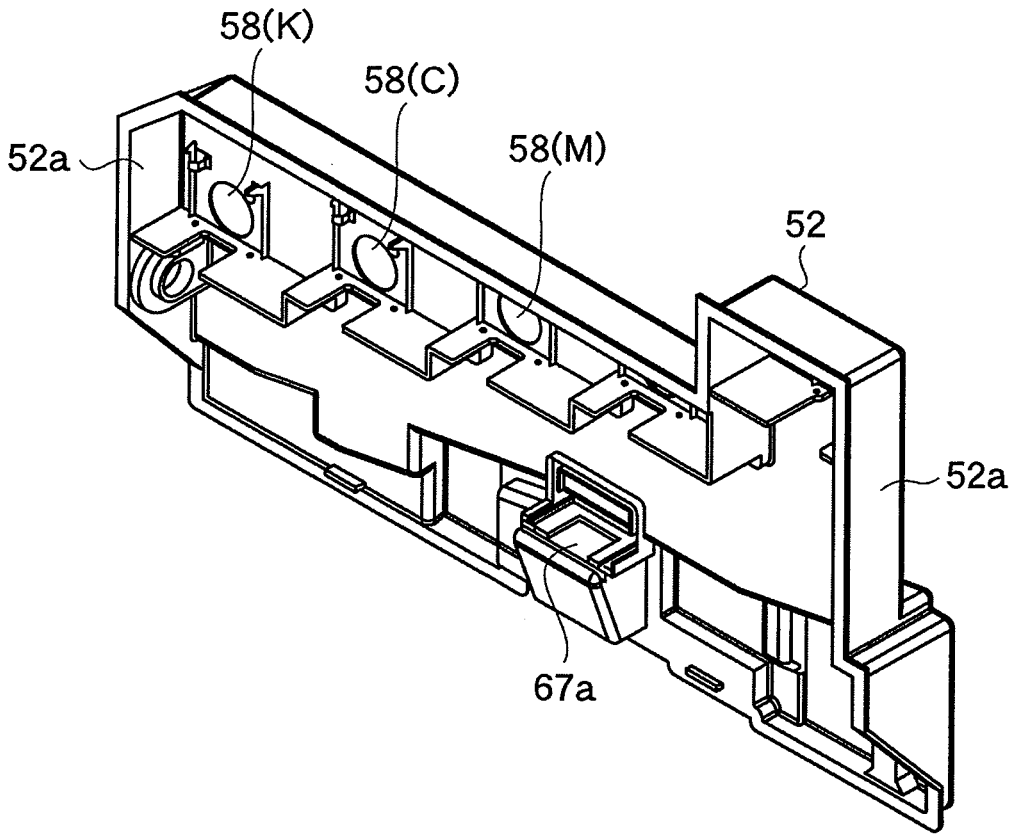
FIG. 7 is a perspective view illustrating the inside of a rear cover that is a composing element of the waste toner collecting box according to the one exemplary embodiment of the invention.

As illustrated in FIGS. 5 and 7, five collecting openings 58 are formed in an upper portion of the rear cover 52. These openings are waste collecting openings for collecting waste toner discharged from the image forming engines 10Y, 10M, 10C, and 10K. When the waste toner collecting box 50 is installed in the printer 1, connecting pipes (not shown) protruded frontwardly from the drum cleaners 14 and the belt cleaners 23 of the image forming engines 10Y, 10M, 10C, and 10K are inserted into the collecting openings 58. Waste toner discharged from the drum cleaner 14 in the case of employing the trickle method is dropped into the waste toner collecting box 50. The five collecting openings 58 respectively correspond to the drum cleaner 14 associated with black, the drum cleaner 14 associated with cyan, the drum cleaner 14 associated with magenta, and the drum cleaner 14 associated with yellow, and the belt cleaner 23, which are arranged in this order from the right side of paper on which FIG. 5 is drawn.

Thus, the waste toner collecting box 50 is provided on one sides of the image forming engines 10Y, 10M, 10C, and 10K and the belt cleaner 23 to be hung on and over these sides thereof. Accordingly, the waste toner discharged from the image forming engines 10Y, 10M, 10C, and 10K and the belt cleaner 23 is dropped directly into the waste toner collecting box 50.

Figure 8:
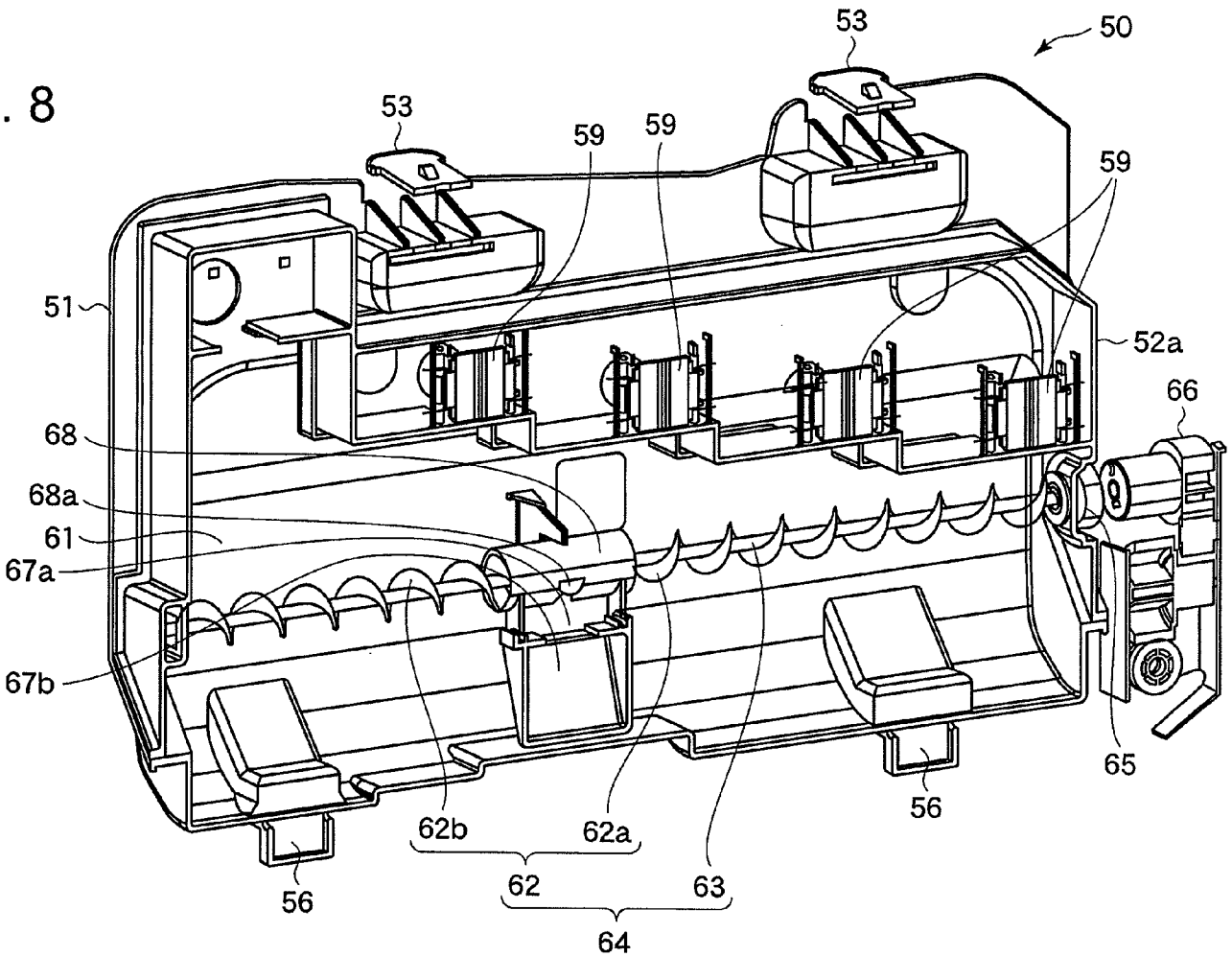
FIG. 8 is a perspective view illustrating the inner structure of the waste toner collecting box according to the one exemplary embodiment of the invention, which is taken from a rear side thereof.

As illustrated in FIG. 8, a shutter 59 is provided at each collecting opening 58. Each shutter 59 has a double-doored structure so as to open and close a left-half part and a right-half part from and to the center thereof. Each shutter 59 is openably and closably attached to the inner side of the rear cover 52. A torsion spring 60 for pushing an associated one of the shutters 59 against the wall surface of the rear cover 52 to close the collecting opening 58 is attached to the associated one of the shutters 59 (see FIG. 9). Thus, usually, each shutter 59 closes the associated collecting opening 58 by the resilient force of the associated torsion spring 60. When the aforementioned connecting pipe is inserted into the associated collecting opening 58, the shutter 59 is inwardly pushed against the resilient force of the associated torsion spring 60 by the associated connecting pipe so as to bring the associated collecting opening 58 into an open state.

Figure 9:
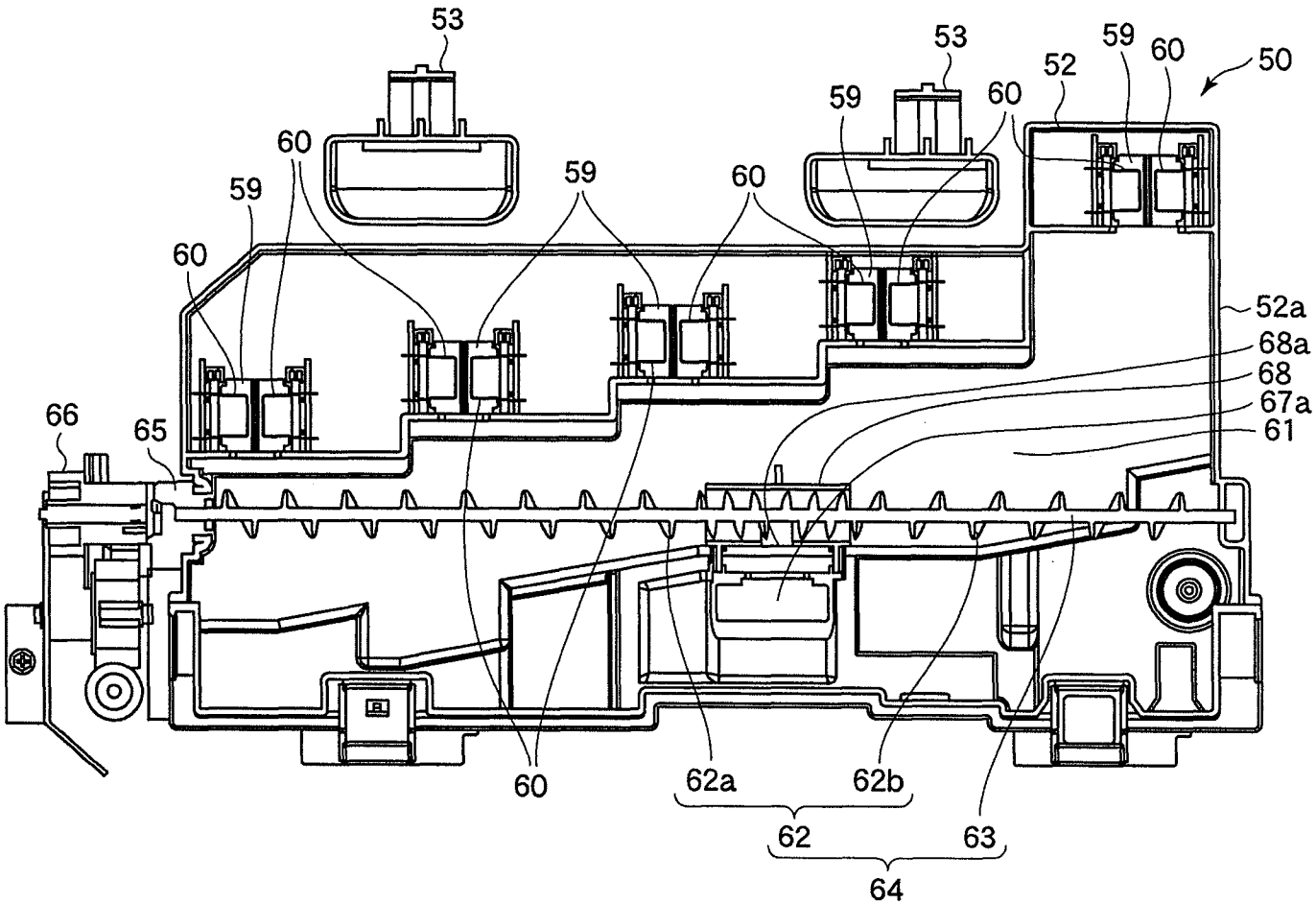
FIG. 9 is a perspective view illustrating the inner structure of the waste toner collecting box according to the one exemplary embodiment of the invention, which is taken from a front side thereof.

As illustrated in FIGS. 8 and 9, a storing chamber 61 (i.e., an example of the first chamber) for storing collected waste toner is formed in the waste toner collecting box 50 including the front cover 51 and the rear cover 52. The storing chamber 61 is located below the collecting openings 58. Waste toner is dropped into the storing chamber 61 through the connecting pipe inserted into each collecting opening 58. When the storing chamber 61 is filled with the waste toner (i.e., an amount of the stored waste toner reaches an upper-limit zone for accommodating powder in the storing chamber 61), necessity for replacing the waste toner collecting box 50 is raised.

A conveying unit 64 is provided in the storing chamber 61 to extend along a longitudinal direction thereof. The conveying unit 64 is provided astride side walls of the storing chamber 61 (i.e., the left and right side walls 52*a* of the rear cover 52). In a case where the waste toner dropped into the storing chamber 61 is banked just under each collecting opening 58, and where the level of the top of a heap of the stored waste toner exceeds that corresponding to the upper limit to the level of waste toner stored in the waste toner collecting box 50, the waste toner is conveyed by tearing down a top part of the heap of the waste toner, which is higher than the upper limit to the level of the waste toner stored in the waste toner collecting box 50.

One side of the conveying unit 64 is supported by a bearing 65 provided on the side wall 52*a* and has a leading end protruded to the outside therefrom. The leading end thereof is an end portion at which a drive force (torque) is supplied to the conveying unit 64, i.e., a torque supplying side end portion. A transmitting unit 66 provided with a transmitting gear train (not shown) for transmitting to the conveying unit 64 a drive force supplied from a drive source (not shown) provided in the printer 1 is attached to the leading end of the conveying unit 64. Accordingly, when the waste toner collecting box 50 is mounted in the printer 1, the transmitting unit 66 is mechanically coupled to a drive source provided in the printer 1. Consequently, the conveying unit 64 is driven (i.e., rotated) by the drive source.

The conveying unit 64 is manufactured by, e.g., injection-molding of a synthetic resin. A helical blade 62 (an example of the blade) for conveying waste toner is formed around a rotary shaft 63. The helical blade 62 includes a first blade 62*a* and a second blade 62*b* that differ from each other in winding-direction. The winding-direction of each of the blades 62*a* and 62*b* is set to be a direction in which waste toner is conveyed to the center from each of both ends of the rotary shaft 63 when the rotary shaft 63 is rotated.

Each of the blades 62*a* and 62*b* ends at a position between a location just under the collecting opening 58 corresponding to yellow waste toner Y and a location just under the collecting opening 58 corresponding to magenta waste toner M. Thus, this position is a conveying end at which the conveyance of the waste toner is ended. Accordingly, when the conveying unit 64 is rotated, the heap of the waste toner banked in the storing chamber 61 is torn down towards this position.

The shapes of the blades for conveying waste toner are not limited to the helical shapes which have been described in the foregoing description of the present exemplary embodiment. The blades can be set as, e.g., plural plate-like blades provided by being spaced from one another. That is, blades having various shapes can be applied to powder collecting containers according to the invention, as long as the blades have the function of conveying waste toner.

Figure 10:
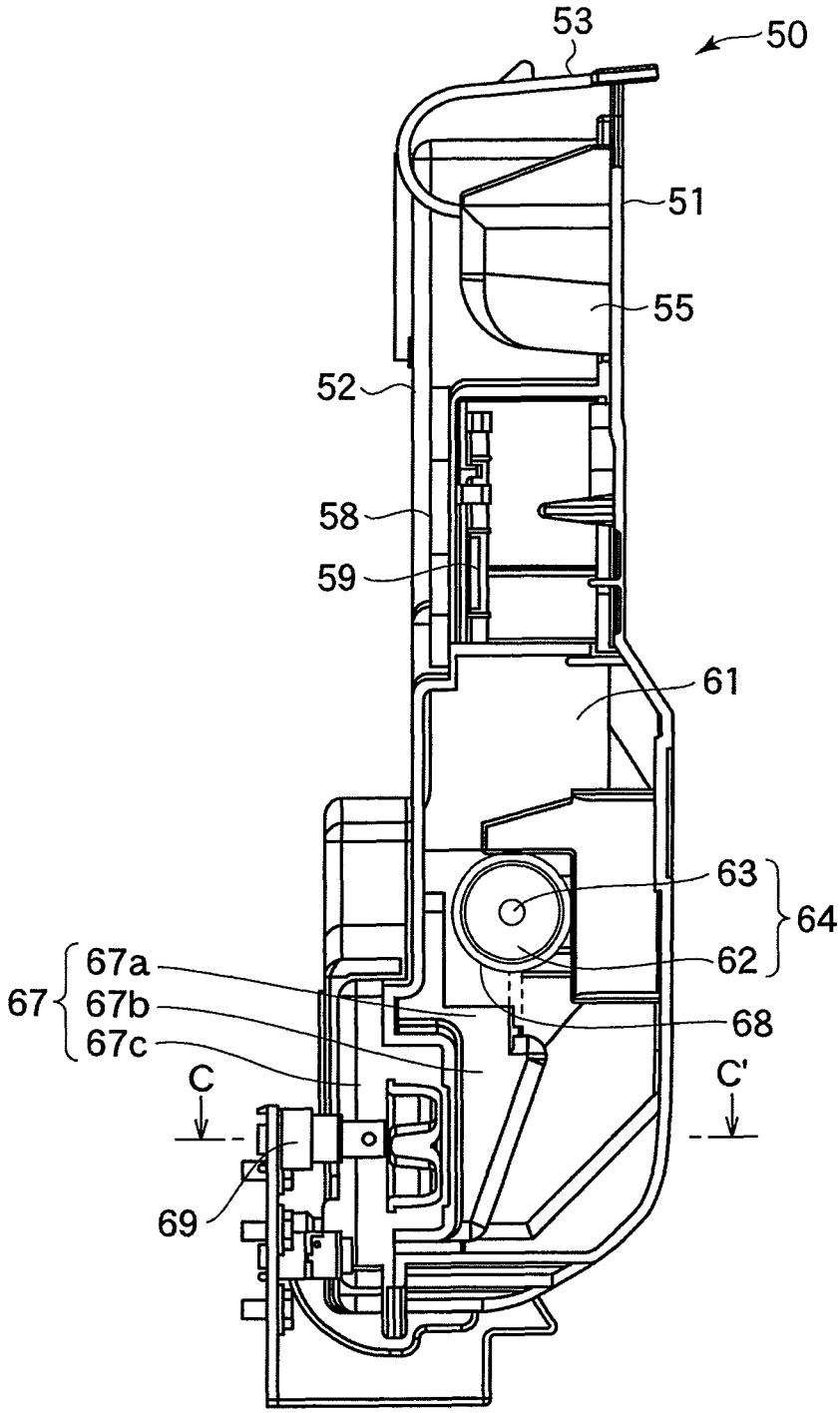
FIG. 10 is a cross-sectional view taken along line B-B' illustrated in FIG. 4.

As illustrated in FIG. 10, a detecting chamber 67 (i.e., an example of the second chamber) to which waste toner whose amount-level exceeds the upper limit to the accommodation level of the storing chamber 61 is introduced is spatially connected to the storing chamber 61. When the waste toner is deposited in the storing chamber 61 to a predetermined level (i.e., the upper limit to the level of the waste toner stored in the storing chamber 61), an excess (i.e., an amount corresponding to a level-difference by which the level of the top of the heap of the waste toner exceeds the upper limit to the level of the waste toner stored in the storing chamber 61) of the waste toner enters the detecting chamber 67.

Figure 11:
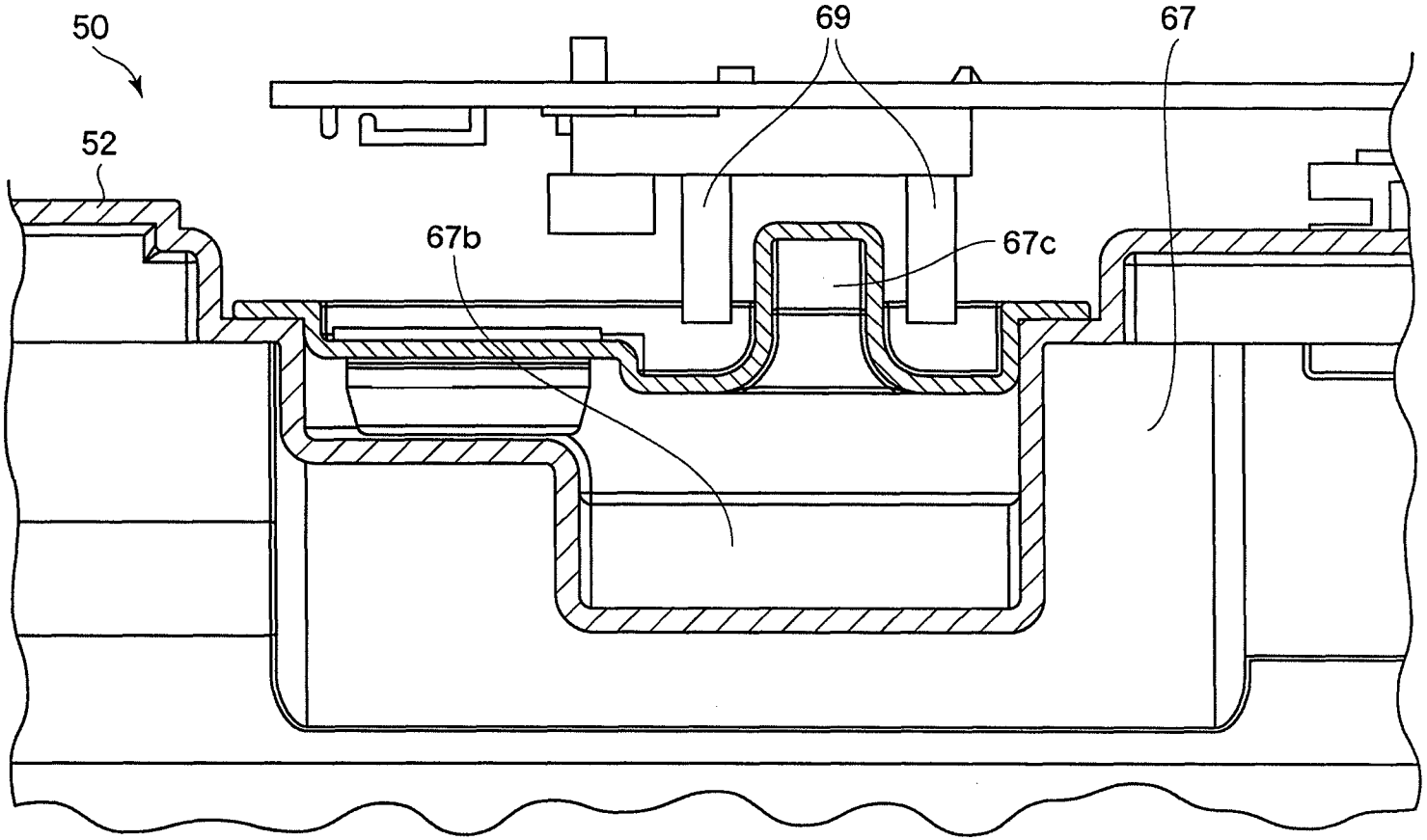
FIG. 11 is a cross-sectional view of a primary part of the waste toner collecting box, which is taken along line C-C' illustrated in FIG. 10.

As illustrated in FIG. 11, the detecting chamber 67 is attached to the rear cover 52 and has a sensing chamber 67*c* formed of a transparent member protruding outwardly. When the waste toner collecting box 50 is installed in the printer 1, waste toner enters a space between a light emitting portion and a light receiving portion of an optical transmission type sensor 69 provided at the side of the printer 1.

As illustrated in FIG. 10, a sloping surface is formed in a waste toner passage 67*b* extending from an inlet 67*a* of the detecting chamber 67 so that the conveying unit 64 is located downwardly. That is, the sensing chamber 67*c* is not placed just under the inlet 67*a*. Thus, waste toner dropped from the storing chamber 61 is gradually deposited in the sensing chamber 67*c* due to the sloping surface of the waste toner passage 67*b*. When the waste toner in the sensing chamber 67*c* blocks the light receiving portion from the light emitting portion of the above optical transmission type sensor 69, a signal output from the optical transmission type sensor 69 is changed. Consequently, it is grasped according to the output signal whether the waste toner is deposited to a predetermined level in the storing chamber 61.

The inlet 67*a* of the detecting chamber 67 is formed at a position at which the first blade 62*a* and the second blade 62*b* of the aforementioned conveying unit 64 end, i.e., at a position facing the conveying end. Thus, the waste toner whose amount exceeds the upper limit to the level of the waste toner stored in the storing chamber 61 is conveyed by the conveying unit 64 towards to the inlet 67*a* of the detecting chamber 67.

Figure 12:
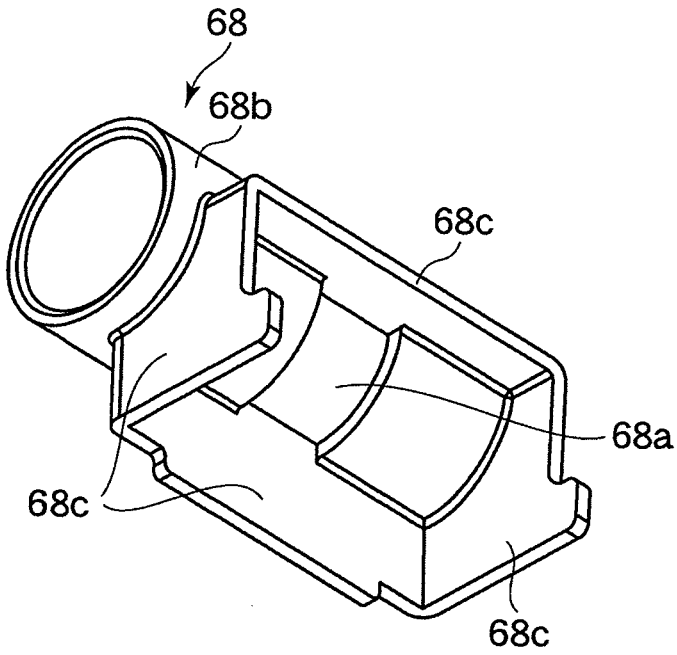
FIG. 12 is a perspective view illustrating a pipe that is a composing element of the waste toner collecting box according to the one exemplary embodiment of the invention, which is taken from frontally below.
Figure 13:
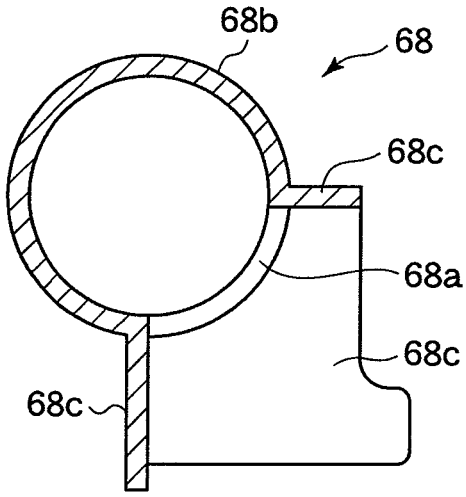
FIG. 13 is a cross-sectional view of the pipe illustrated in FIG. 12.

As illustrated in FIGS. 12 and 13, a pipe 68 (an example of the hollow member) through which the conveying unit 64 penetrates is placed at the inlet 67*a* of the detecting chamber 67. In the pipe 68, an opening portion 68*a* is formed in a peripheral wall 68*b* serving as a body portion. The above opening portion 68*a* faces the inlet 67*a* of the detecting chamber 67. Accordingly, the conveying unit 64 is such that the waste-toner conveying end serving as a part at which the blades 62*a* and 62*b* end is located at the opening portion 68*a* of the pipe 68 (see FIG. 14). Thus, no waste toner enters the detecting chamber 67, unless passing through the pipe 68. In order to prevent waste toner from entering the detecting chamber 67 from a place other than the opening portion 68*a* of the pipe 68, a partition wall 68*c* for partitioning the inlet 67*a* of the detecting chamber 67 from the storing chamber 61 is formed to extend downwardly from the peripheral wall 68*b*.

According to the present exemplary embodiment, a material constituting the pipe 68 differs from that constituting a casing (including the front cover 51 and the rear cover 52). As is known by comparing the friction coefficient between the material constituting the conveying unit 64 and the material constituting the casings 51 and 52 with the friction coefficient between the material constituting the conveying unit 64 and the material constituting the pipe 68, the latter friction coefficient is smaller than the former friction coefficient.

The present exemplary embodiment is more specifically described hereinafter. That is, acrylonitrile-butadiene-styrene terpolymer (ABS resin), into which glass fibers for enhancing the strength and the heat resistance thereof are mixed is used as the material constituting the casings 51 and 52 and the conveying unit 64. On the other hand, polyacetal (POM) is used as the material constituting the pipe 68.

The friction coefficient between the conveying unit 64 and each of the casings 51 and 52, all of which employ ABS resin as the constituent material thereof, is about 0.4. On the other hand, the friction coefficient between the conveying unit 64 employing ABS resin as the constituent material and the pipe 68 employing POM as the constituent material is about 0.2. Accordingly, as compared with the case of setting the constituent material of the pipe 68 to be the same as the constituent material of the casings 51 and 52, the pipe 68 is in friction with the conveying unit 64 with a low frictional force. Thus, noise generated when the conveying unit 64 rotates is more reduced.

The constituent materials of the casings 51 and 52, the conveying unit 64 and the pipe 68 are not limited to the above exemplified materials. Various materials are applied to these constituent materials so that the friction coefficient between the material constituting the conveying unit 64 and the material constituting the pipe 68 is smaller than the friction coefficient between the material constituting the conveying unit 64 and the material constituting the casings 51 and 52. For example, in a case where ABS resin is used as the constituent material of the casings 51 and 52 and the conveying unit 64, polyamide (PA), polyethylene (PE) and polytetrafluoroethylene (PTFE) are applied to the constituent material of the pipe 68, in addition to POM.

Figure 14:
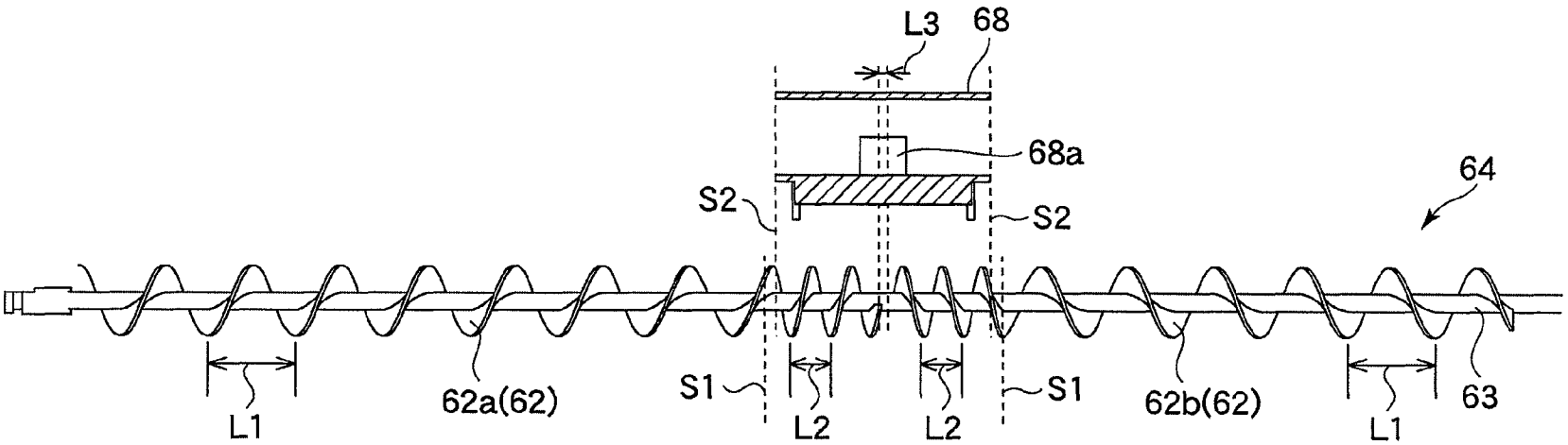
FIG. 14 is an explanatory view illustrating the relationship between a conveying unit provided in the waste toner collecting box according to the one exemplary embodiment of the invention and the pipe.

As illustrated in FIG. 14, an interval-value L3 is provided between a part at which the first blade 62*a* ends and a part at which the second blade 62*b* ends. This facilitates the dropping of the conveyed waste toner.

With such a configuration, when the level of the waste toner locally exceeds the upper limit to the level of the waste toner stored in the storing chamber 61, an excessive part of the waste toner is torn down towards the center of the storing chamber 61 at the conveying unit 64. At that time, the waste toner is torn down towards a part corresponding to the discontinuity between the helical blades 62 of the conveying unit 64. Finally, a space is left only under the part corresponding to the discontinuity between the helical blades 62 in the storing chamber 61. When this space disappears due to the conveyance of the waste toner, the storing chamber 61 is filled with waste toner. That is, the level of the waste toner reaches the upper limit to the level of the waste toner stored in the storing chamber 61.

Then, the excessive part, by which the level of the waste toner exceeds the upper limit to the level of the waste toner stored in the storing chamber 61, is conveyed to the conveying unit 64. Thus, the excessive part of the waste toner enters the inside of the pipe 68. Then, the waste toner set in the pipe 68 enters the detecting chamber 67 from the opening portion 68*a* of the pipe 68 and is detected by the optical transmission type sensor 69 in the sensing chamber 67*c*, as described above. Consequently, an output signal of the optical transmission type sensor 69 is changed. Thus, it is grasped that the storing chamber 61 is full.

When the image forming engines 10Y, 10M, 10C, and 10K are replaced, necessity for detaching the waste toner collecting box 50 placed at the near side of the image forming engines 10Y, 10Y, 10C, and 10K is raised. In a case where the detached waste toner collecting box 50 is put into a state in which the rotary shaft 63 of the conveying unit 64 does not horizontally extend (i.e., the rotary shaft 63 is inclined or extends in an up/down direction), when the aforementioned pipe 68 is absent, the waste toner stored in the storing chamber 61 is torn down, so that a part of the waste toner enters the detecting chamber 67 from the inlet 67*a*. When waste toner, whose amount is sufficient to the extent that the waste toner can be detected by the optical transmission type sensor 69, enters the detecting chamber 67, in a case where the waste toner collecting box 50 is installed in the printer 1, although the storing chamber 61 is not filled with waste toner, an output signal of the optical transmission type sensor 69 is changed. Thus, it is erroneously detected that the storing chamber 61 is full.

In the storing chamber 61, powder dust generated from waste toner is suspended. When waste toner is conveyed by the conveying unit 64, e.g., when a heap of waste toner, whose level of the top thereof locally exceeds the upper limit to the level of the waste toner stored in the storing chamber 61, is torn down by the conveying unit 64, a particularly large amount of powder dust is generated. Accordingly, when the pipe 68 is absent, the generated powder dust is not conveyed by the conveying unit 64, because the powder dust is light, as compared with the waste toner itself. Thus, the power dust enters the detecting chamber 67 from the inlet 67*a* while a part of the power dust is suspended therein. Then, such a state is iteratively caused. Consequently, when powder dust whose amount is sufficient to the extent that the powder dust can be detected by the optical transmission type sensor 69 is accumulated in the detecting chamber 67, although the storing chamber 61 is not filled with waste toner, an output signal of the optical transmission type sensor 69 is changed. Thus, it is erroneously detected that the storing chamber 61 is full.

On the other hand, according to the present exemplary embodiment, the conveying unit 64 having the helical blades 62 penetrates through the pipe 68. The conveying end faces the opening portion 68*a* of the pipe 68. The waste toner stored in the storing chamber 61 does not enter the detecting chamber 67, unless the waste toner passes through the pipe 68. Accordingly, waste toner which is torn down when the waste toner collecting box 50 is dismounted from the printer, and the powder dust which is generated when the conveying unit 64 conveys the waste toner, are blocked by the pipe 68 and the helical blades 62 and prevented from entering the detecting chamber 67. Consequently, waste toner collecting box 50 can be prevented from being erroneously detected as being full. Thus, detection accuracy is enhanced.

In the configuration using the pipe 68 in this manner, the conveying unit 64 is rotatably supported at two places, i.e., the pipe 68 and the aforementioned torque supplying side end portion (i.e., an end portion at which torque is supplied to the conveying unit 64). However, an end portion opposite to the torque supplying side end portion is not supported.

With such a configuration, as compared with a case where the end portion opposite to the torque supplying side end portion is also supported, i.e., where the three portions are supported, the number of portions for supporting the conveying unit 64 is reduced by 1. Thus, noise generated when the conveying unit 64 rotates is reduced.

Figure 15:
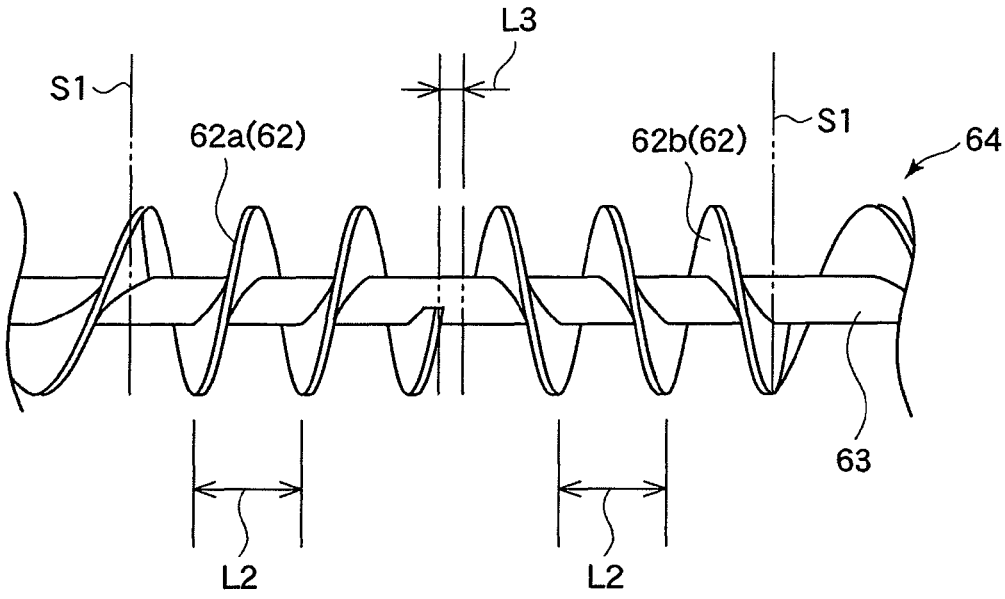
FIG. 15 is an explanatory view illustrating a primary part of the pipe illustrated in FIG. 14.

As illustrated in FIGS. 14 and 15, the printer 1 has two types of the pitch (or interval) of windings of each of the blades 62*a* and 62*b*, i.e., a first helical pitch L1 and a second helical pitch L2 that is smaller than the first helical pitch L1. According to the present exemplary embodiment, the first helical pitch is, e.g., 20 mm. The blade wound at the first helical pitch is located outside the pipe 68. The second helical pitch is, e.g., 9 mm. The blade wound at the second helical pitch is located in the inside of the pipe. However, the pitches of windings of each of the blades 62*a* and 62*b* are not limited to the above values. As long as the second helical pitch is smaller than the first helical pitch, various intervals can be employed as the first and second helical pitchs.

As illustrated in FIG. 14 in detail, the boundary positions S1 between each region in which the blade is wound at the first helical pitch L1 and another region in which the blade is wound at the second helical pitch L2 is located more outside the pipe 68 than the position S2 of the end portion of the pipe 68. That is, as viewed from a direction in which waste toner is conveyed, the region in which the blade is wound at the second helical pitch L2 starts to extend from a position outside the pipe 68 and continues to extend to the conveying end in the pipe 68.

As a result of setting the pitch of windings of each of the blades 62 provided in the pipe 68 at the second helical pitch L2 that is narrower than the first helical pitch, the gap between the helical blades 62 is reduced at a place at which each blade overlaps with an associated end portion of the pipe 68. Consequently, the space that accommodates waste toner is reduced. Thus, the waste toner torn down when the waste toner collecting box 50 is removed becomes difficult to enter the pipe 68. Accordingly, the waste toner is difficult to reach the opening portion 68*a* of the pipe 68. It can surely be prevented from being erroneously detected that the waste toner collecting box 50 is full.

In addition, according to the present exemplary embodiment, the region in which each of the helical blades 62 is wound at the second helical pitch L2 extends from the entire inside region of the pipe 68 to a part of each zone outside the pipe 68. Thus, a portion in which the gap between the helical blades 62 is small surely covers the entire region of the pipe 68. Consequently, waste toner is more surely prevented from entering the pipe 68.

As compared with a case where the interval of windings of each of the helical blades provided in the pipe 68 is set at the first helical pitch L1, the contact area between the inner peripheral wall of the pipe 68 and each helical blade 62 increases. Thus, an amount of friction per unit area, which is caused between the inner wall of the pipe 68 and each helical blade 62, is reduced. Consequently, noise generated when the conveying unit 64 rotates is reduced.

The pitch of windings of each of the blades 62 in the pipe 68 is set at the second helical pitch L2 that is narrower than the first helical pitch. Thus, as compared with the case of setting the interval of windings of each of the blades 62 in the pipe 68 at the first helical pitch L1, the contact area between each helical blade 62 and the inner wall of the pipe 68 is reduced. Consequently, noise generated when the conveying unit 64 rotates is more reduced.

Thus, according to the present exemplary embodiment, the region in which each of the helical blades 62 is wound at the second helical pitch L2 extends from the entire inner region of the pipe 68 to a part of the outside thereof. In order to make it difficult to cause waste toner to reach the opening portion 68*a* of the pipe 68, it is sufficient that each of the blades wound at the interval-value L2 is located at a place facing an end portion of the pipe 68. However, it is considered that unless the number of windings of each of the helical blades 62 wound at the second helical pitch L2 is equal to or more than 1, the effect of blocking waste toner more effectively than the case of setting the number of the windings at the first helical pitch L1 cannot be obtained.

In addition, according to the present exemplary embodiment, the material constituting the pipe 68 differs from that constituting the casing (including the front cover 51 and the rear cover 52). The friction coefficient between the material constituting the conveying unit 64 and that constituting the pipe 68 is smaller than that between the material constituting the conveying unit 64 and that constituting the casings 51 and 52. Accordingly, as compared with the case of setting the constituent material of the pipe 68 to be the same as those of the casings 51 and 52, nose generated when the conveying unit 64 rotates is more reduced, because the pipe 68 is in friction with the conveying unit 64 with a low frictional force.

According to the present exemplary embodiment, the helical blades 62 are provided over the entire region of the rotary shaft 63. However, it is sufficient that the helical blade 62 is formed at a place overlapping with the waste toner collecting opening 58 outside the pipe 68. That is, it is sufficient to form a part, in which the interval of windings of the helical blade 62 is the first helical pitch L1, at a place which overlaps with the waste toner collecting opening 58.

When the helical blade 62 is formed only at a place overlapping one above the other with the collecting opening 58 outside the pipe 68, an amount of waste toner is restrained from being increased at a part facing the collecting opening 58 in which an amount of waste toner tends to increase. In addition, the surface area of each of the helical blades 62 serving as members to which waste toner can adhere is reduced.

The entry of waste toner into the pipe 68 can be also made difficult by changing the inclination of the helical blade 62 in a part in which the interval of windings of the helical blade 62 is the first helical pitch L1 and in another part in which the interval of windings of the helical blade 62 is the second helical pitch L2. That is, the inclination of the helical blade 62 in the part in which the interval of windings of the helical blade 62 is the first helical pitch L1 is set at a first inclination angle, while the inclination of the helical blade 62 in the part in which the interval of windings of the helical blade 62 is the second helical pitch L2 is set at a second inclination angle By setting the second inclination angle which is inclined to a larger direction from the rotary shaft 63 than the first inclination angle, similarly to the case of setting the interval of windings of the blades at different values, the gap between the helical blades 62 in the part overlapping with the end portion of the pipe 68 becomes small. Thus, the space in which the waste toner is accommodated is reduced. Consequently, the waste toner torn down when the waste toner collecting box 50 is removed is made to be difficult to enter the pipe 68.

Incidentally, the part, in which the interval of windings of the helical blade 62 is the first helical pitch L1, and the part, in which the interval of windings of the helical blade 62 is the second helical pitch L2 can differ from each other only in one of the interval of windings of the blade and the inclination of the blade. However, the part, in which the interval of windings of the helical blade 62 is the first helical pitch L1, and the part, in which the interval of windings of the helical blade 62 is the second helical pitch L2 can be made to differ from each other in both the interval of windings of the blade and the inclination of the blade. In the case of shaping the blades like a plate, the interval of windings of the blade and the inclination of the blade can be changed independent of each other.

Figure 16:
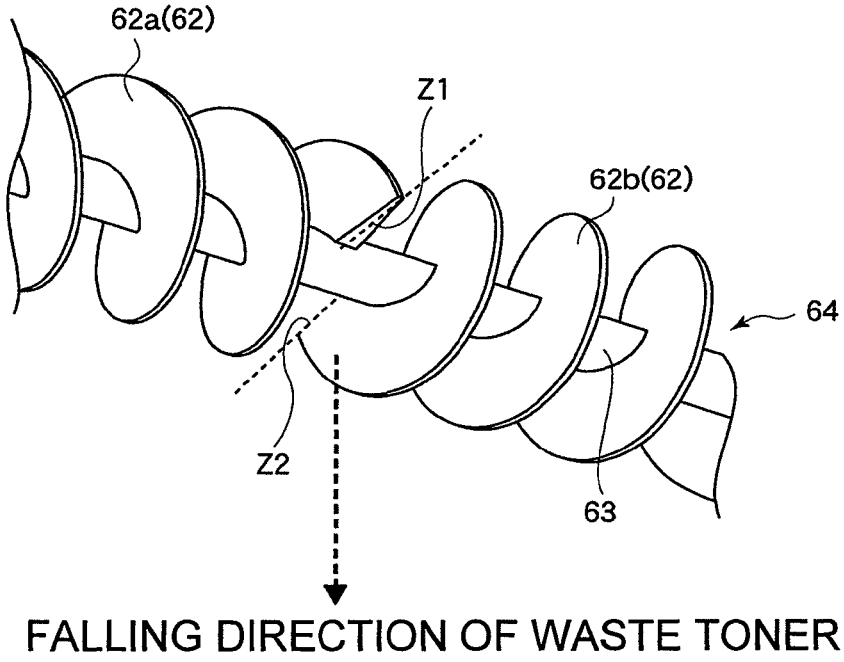
FIG. 16 is a perspective view illustrating the primary part of the pipe illustrated in FIG. 14.

As illustrated in FIG. 16, the phase at the conveying end Z1 of the first blade 62*a* differs from that at the conveying end Z2 of the second blade 62*b*. According to the present exemplary embodiment, both of these phases are opposite to each other (i.e., differ from each other by about 180°).

With such a configuration, a time taken by waste toner conveyed by the first blade 62*a* to reach the conveying end Z1 surely differs from that taken by waste toner conveyed by the second blade 62*b* to reach the conveying end Z2. Consequently, the falling timing of waste toner conveyed by the first blade 62*a* differs from that of waste toner conveyed by the second blade 62*b*. Thus, the opening portion 68*a* of the pipe 68 is prevented from being clogged due to the congestion of waste powder at the conveying ends Z1 and Z2 to which the waste powder gathers.

In addition, because the phase at the conveying end Z1 of the first blade 62*a* is opposite to that at the conveying end Z2 of the second blade 62*b*, the waste toner conveyed by the first blade 62*a* and the waste toner conveyed by the second blade 62*b* alternately fall to the detecting chamber 67 from the opening portion 68*a* of the pipe 68. Accordingly, the congestion of the waste toner can more surely be prevented from occurring at the conveying ends Z1 and Z2.

However, it is sufficient that the phase at the conveying end Z1 of the first blade 62*a* differs from the phase at the conveying end Z2 of the second blade 62*b*. The former phase is opposite to the latter phase.

In the foregoing description, the invention accomplished by the present inventor has specifically been described with reference to the exemplary embodiments. However, it should be understood that the exemplary embodiments disclosed in the present specification are illustrative in all respects, and are not limited to the disclosed technology. That is, the technical scope of the invention should not be construed as limitative based on the description of the exemplary embodiments, but rather construed according to the appended claims, and includes technologies within the scope of the appended claims, equivalent technologies, and all changes within the scope of the appended claims.

For example, in the present exemplary embodiment, the blades of the conveying unit 64 include the first blade 62*a* and the second blade 62*b* that convey waste toner in two directions from both ends of the rotary shaft 63 to the center thereof. As long as the printer is configured so that the phase at the conveying end Z1 of the first blade 62*a* is not made to differ from the phase at the conveying end Z2 of the second blade 62*b*, the conveying unit can be constituted only by one blade which has only one winding direction and conveys waste toner only in one direction of the rotary shaft 63.

In the foregoing description, an example has been described, in which the powder collecting container according to the invention is applied to the image forming apparatus for recording an image in the form of a color image. However, the powder collecting container according to the invention can be applied to an image forming apparatus for recording an image in the form of a monochrome image.

What is claimed is:

1. A powder collecting container, comprising:

a first chamber that is configured to store collected powder;

a conveying unit that has a rotary shaft, and a powder conveying blade formed to be wound around the rotary shaft, the conveying unit being arranged at least in the first chamber and configured to convey powder which is contained in the first chamber;

a hollow portion through which the conveying unit passes; and a second chamber that has an inlet arranged below the rotary shaft in a vertical direction so that powder conveyed by the conveying unit into the hollow portion enters the second chamber from the inlet.

2. The powder collecting container according to claim 1, further comprising:

a collecting opening that is provided in the first chamber so that powder is collected through the collecting opening, wherein a inclination of the powder conveying blade includes:

a first inclination angle set in a portion overlapping with the collecting opening to an axial direction of the rotary shaft; and a second inclination angle inclined to a larger direction from the rotary shaft than the first inclination angle in the conveying direction, a second inclination angle set in a portion facing an end portion of the hollow portion to the axial direction of the rotary shaft so that the powder conveying blade is large angle with respect to the direction of the rotary shaft than a case where the inclination of the powder conveying blade is the first inclination angle.

3. The powder collecting container according to claim 2, wherein a region in which the inclination of the powder conveying blade is the second inclination angle extends from the entire inner side of the hollow portion to a part located outside the hollow portion.

4. The powder collecting container according to claim 1, wherein the blade includes a first-blade and a second-blade which convey powder in two directions from both ends of the rotary shaft to the center thereof, and wherein a phase at a conveying end of the first-blade differs from that at a conveying end of the second-blade.

5. The powder collecting container according to claim 4, wherein the phase at the conveying end of the first-blade is opposite to that at the conveying end of the second-blade.

6. The powder collecting container according to claim 1; further comprising:

a casing in which a first chamber configured to store collected powder, and a second chamber spatially connected to the first chamber are formed, wherein the conveying unit is rotatably supported at two parts that are a supplying side end portion serving as an end portion at which torque is supplied to the conveying unit, and the hollow portion.

7. The powder collecting container according to claim 6, further comprising:

a collecting opening that is provided in the first chamber so that powder is collected through the collecting opening, wherein a helical pitch of the powder conveying blade includes:

a first helical pitch set in a portion overlapping with the collecting opening in an axial direction of the rotary shaft; and a second helical pitch set in a portion located in an inside of the hollow member in an axial direction of the rotary shaft so as to be smaller than the first helical pitch.

8. The powder collecting container according to claim 6, wherein a friction coefficient between a material constituting the conveying unit and a material constituting the hollow member is smaller than that between a material constituting the conveying unit and a material constituting the casing.

9. An image forming apparatus, comprising:

a powder collecting container according to claim 1.

10. A powder collecting container, comprising:

a first chamber that is configured to store collected powder;

a conveying unit that has a rotary shaft, and a powder conveying blade formed to be wound around the rotary shaft, the conveying unit being arranged at least in the first chamber and configured to convey powder which is contained in the first chamber;

a hollow portion through which the conveying unit passes;

a second chamber that has an inlet arranged below the rotary shaft in a vertical direction so that powder conveyed by the conveying unit into the hollow portion enters the second chamber from the inlet; and a collecting opening that is provided in the first chamber so that powder is collected through the collecting opening, wherein a helical pitch of the powder conveying blade includes:

a first helical pitch set in a portion overlapping with the collecting opening in an axial direction of the rotary shaft; and a second helical pitch set in a portion in the axial direction of the rotary shaft so as to be smaller than the first helical pitch.

11. The powder collecting container according to claim 10, wherein a region in which the helical pitch of the powder conveying blade is the second helical pitch extends from the entire inner side of the hollow member to a part located outside the hollow member.

12. An image forming apparatus, comprising:

a powder collecting container according to claim 10.

13. A powder collecting container, comprising:

a first chamber that is configured to store collected powder;

a conveying unit that has a rotary shaft, and a powder conveying blade formed to be wound around the rotary shaft, the conveying unit being arranged at least in the first chamber and configured to convey powder which is contained in the first chamber;

a hollow portion through which the conveying unit passes; and a second chamber that has an inlet so that powder conveyed by the conveying unit into the hollow portion enters the second chamber from the inlet, wherein a first portion of the powder conveying blade outside of the hollow portion is configured to convey a larger amount of the powder than a second portion of the powder conveying blade that is located inside of the hollow portion.

14. The powder collecting container according to claim 6, further comprising:

a collecting opening that is provided in the first chamber so that powder is collected through the collecting opening, wherein a inclination of the powder conveying blade includes:

a first inclination angle set in a portion overlapping with the collecting opening to an axial direction of the rotary shaft; and a second inclination angle inclined to a larger direction from the rotary shaft than the first inclination angle in the conveying direction, a second inclination angle set in a portion facing an end portion of the hollow portion to the axial direction of the rotary shaft so that the powder conveying blade is large angle with respect to the direction of the rotary shaft than a case where the inclination of the powder conveying blade is the first inclination angle.

15. The powder collecting container according to claim 14, wherein a region in which the inclination of the powder conveying blade is the second inclination angle extends from the entire inner side of the hollow portion to a part located outside the hollow portion.

16. The powder collecting container according to claim 6, wherein the blade includes a first-blade and a second-blade which convey powder in two directions from both ends of the rotary shaft to the center thereof, and wherein a phase at a conveying end of the first-blade differs from that at a conveying end of the second-blade.

17. The powder collecting container according to claim 16, wherein the phase at the conveying end of the first-blade is opposite to that at the conveying end of the second-blade.

18. The powder collecting container according to claim 13; further comprising:

a casing in which a first chamber configured to store collected powder, and a second chamber spatially connected to the first chamber are formed, wherein the conveying unit is rotatably supported at two parts that are a supplying side end portion serving as an end portion at which torque is supplied to the conveying unit, and the hollow portion.

19. The powder collecting container according to claim 18, further comprising:

a collecting opening that is provided in the first chamber so that powder is collected through the collecting opening, wherein a helical pitch of the powder conveying blade includes:

a first helical pitch set in a portion overlapping with the collecting opening in an axial direction of the rotary shaft; and a second helical pitch set in a portion located in an inside of the hollow member in an axial direction of the rotary shaft so as to be smaller than the first helical pitch.

20. The powder collecting container according to claim 18, wherein a friction coefficient between a material constituting the conveying unit and a material constituting the hollow member is smaller than that between a material constituting the conveying unit and a material constituting the casing.

21. An image forming apparatus, comprising:

a powder collecting container according to claim 13.

* * * * *